US005522531A

United States Patent [19]

Ogawa

[11] Patent Number: 5,522,531

[45] Date of Patent: Jun. 4, 1996

[54] SAFETY DEVICE FOR NAILING MACHINE

[75] Inventor: Tatsushi Ogawa, Tokyo, Japan

[73] Assignee: Max Co., Ltd., Tokyo, Japan

[21] Appl. No.: 300,537

[22] Filed: Sep. 6, 1994

[30] Foreign Application Priority Data

Sep. 6, 1993 [JP] Japan ..... 5-053398

[51] Int. Cl.[6] ..... B25D 1/04

[52] U.S. Cl. ..... 227/8; 227/130; 137/116.3; 173/169

[58] Field of Search ..... 227/8, 120, 130; 173/200, 168, 169, 170; 137/115, 494; 251/282

[56] References Cited

U.S. PATENT DOCUMENTS

| | | | |
|---|---|---|---|
| 1,173,518 | 2/1916 | Hoxsie | 137/494 |
| 2,649,688 | 8/1953 | Slomer | 137/115 |
| 2,907,303 | 10/1959 | Ritchie et al. | 173/170 |
| 3,252,641 | 5/1966 | Ciechanowski | 227/8 |

FOREIGN PATENT DOCUMENTS

| | | | |
|---|---|---|---|
| 0657524 | 3/1938 | Germany | 173/170 |

*Primary Examiner*—Rinaldi I. Rada
*Assistant Examiner*—Allan M. Schrock
*Attorney, Agent, or Firm*—Cushman, Darby & Cushman

[57] ABSTRACT

In a safety device for a nailing machine which has a compressed air introducing opening for introducing a compressed air therefrom and an air chamber for storing compressed air introduced from the compressed air introducing opening, the safety device comprises a compressed are passage, a relief valve and a spring. The compressed air passage is provided close to an inner side of the introducing opening, and communicates with the air chamber. The relief valve serves to release the compressed air within the air chamber outside, and has a valve housing, an air leak hole and a valve stem. One end of said valve housing is open onto the air chamber, the other end of the valve housing is open onto the introducing opening, a middle portion of the valve housing communicates with the air leak hole which communicates with the outside. The valve stem is slidably accommodated in the valve housing, one end of the valve stem faces the air chamber and the other end thereof faces the introducing opening. And a spring urges the valve stem toward the air chamber, so that when the valve stem slides toward the introducing opening, the air chamber is caused to communicate with the air leak hole.

3 Claims, 3 Drawing Sheets

SAFETY DEVICE FOR NAILING MACHINE

BACKGROUND OF THE INVENTION

The device relates to a safety device that releases abnormally high pressure compressed air outside in a nailing machine that drives a nail with impact by the compressed air.

Generally, a compressed air-driven nailing machine uses compressed air supplied from a compressed air supply source such as a compressor. Since the supply pressure from the compressed air supply source is usually set in accordance with the output of the nailing machine, it is the compressed air at the set pressure that is supplied to the nailing machine. However, compressed air at a high pressure is sometimes mistakenly supplied with confirmation of the initial setting of the supply pressure from the compressed air supply source forgotten. In this case, abnormally high pressure compressed air drives the drive piston, which makes the impact applied to the nail abnormally so large that accidents occur during the nail driving operation. In addition, there is the possibility that the bumper that is subject to the impact of the drive piston will be broken or that the body of the nailing machine will be cracked.

To overcome this problem, a safety device is provided in ordinary nailing machines. The safety device is designed to leak the abnormally high pressure compressed air outside. One known example is disclosed in, e.g., Japanese Unexamined Utility Model Publication No. 50-28779. This safety device is characterized as decreasing the pressure of the compressed air by releasing the compressed air within the nailing machine outside with a compression spring being compressed to open a relief valve when the pressure of the nailing machine exceeds a predetermined value.

However, for the safety device of this type it takes time to decrease the pressure because the device can leak the compressed air only by small amounts per hour. The nail driving operation is likely to start before the pressure has not been completely decreased.

The recent relaxation of the restriction on the usable air pressure has allowed compressed air of quite a high pressure to be employed. This means that a stiffer compression spring should be used. This also means that the strength of the relief valve itself should be increased accordingly, and hence the relief valve must be larger in size. However, since a small-sized nailing machine capable of using high pressure air is called for from the viewpoint of operability, such a design as to increase the size of the relief valve must be avoided.

SUMMARY OF THE INVENTION

The device has been made in view of the above problem. Accordingly, the object of the device is to provide a safety device for a nailing machine that can not only release the compressed air within a short period of time but also be downsized.

To achieve the above object, the device is applied to a safety device for a nailing machine that includes: an air chamber for storing compressed air introduced from a compressed air introducing opening; a drive piston being driven by the compressed air within the air chamber; a drive cylinder for slidably accommodating the drive piston therein; and a nail injecting section for guiding the sliding of a driver coupled to the drive piston. In such safety device, a compressed air passage and a relief valve are provided close to the inner side of the introducing opening. The compressed air passage communicates with the air chamber, and the relief valve serves to release the compressed air within the air chamber outside. The relief valve has a valve housing and a valve stem. One end of the valve housing is open onto the air chamber; the other end of the valve housing is open onto the introducing opening; and a middle portion of the valve housing communicates with an air leak hole that communicates with the outside. The valve stem is slidably accommodated in the valve housing. One end of the valve stem faces the air chamber and the other end thereof faces the introducing opening. The valve stem is urged by a spring toward the air chamber. As a result, when the valve stem slides toward the introducing opening, the air chamber is caused to communicate with the air leak hole.

According to the above-mentioned construction, the compressed air is supplied from the introducing opening to the air chamber via the compressed air passage, and the air pressure operates on both end portions of the valve stem. If the spring pressure that urges the valve stem toward the air chamber is set to a value larger than the urging pressure that urges the valve stem to move toward the introducing opening based on the difference in the effective pressure receiving area between both end portions of the valve stem, then the valve stem is normally positioned on the air chamber side. When the air pressure within the air chamber is increased, the magnitude of the urging pressure and that of the spring pressure of the compression spring are reversed to cause the valve stem to move toward the introducing opening against the spring pressure, which in turn causes the air chamber to communicate with the air leak hole to thereby release the compressed air within the air chamber outside.

DETAILED DESCRIPTION OF THE PREFERRED EMBODIMENTS

Figure 1:
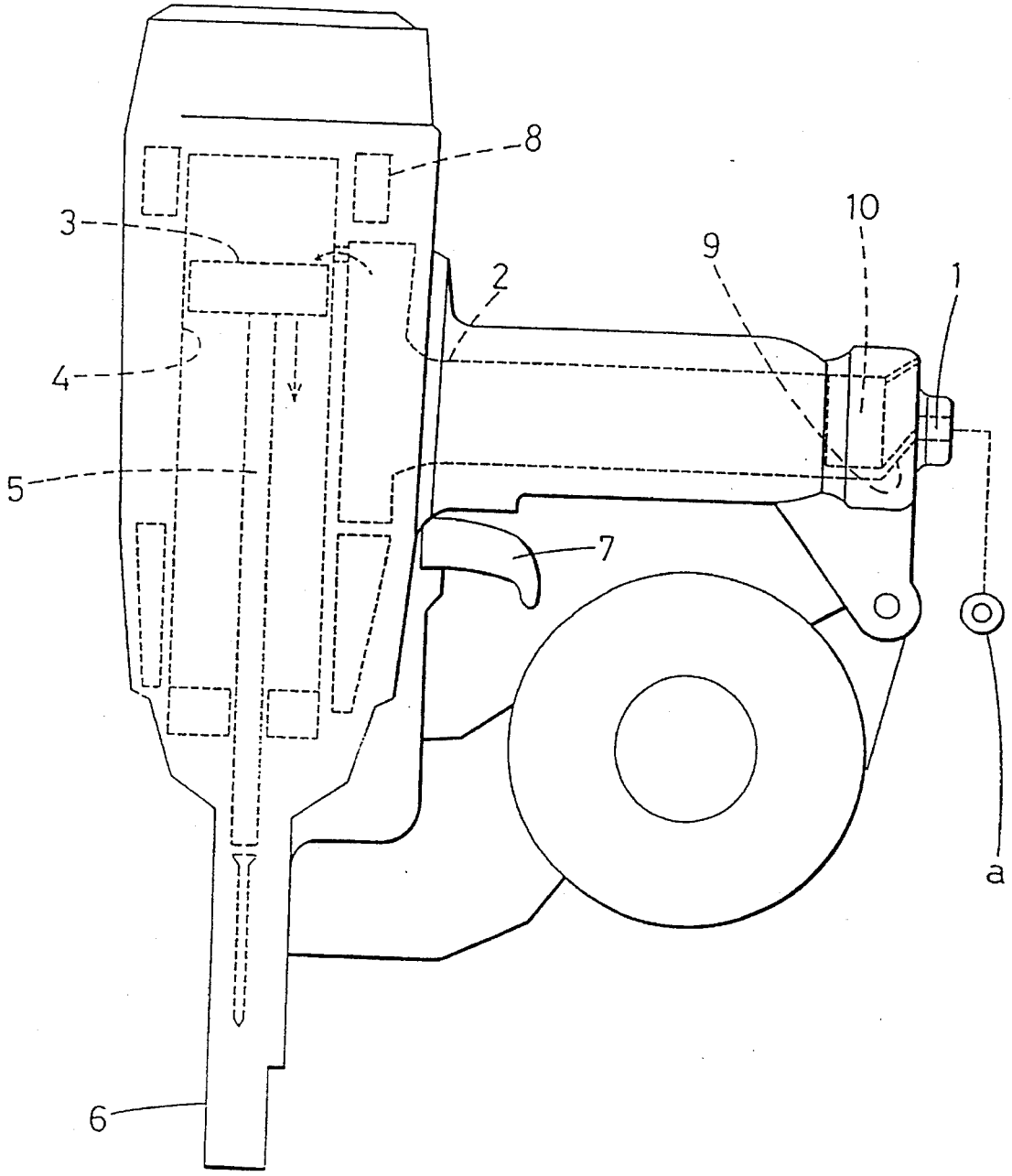
FIG. 1 is a diagram outlining a nailing machine of the device.

FIG. 1 shows a nailing machine that operates with compressed air. This nailing machine includes: an air chamber 2; a drive piston 3; a drive cylinder 4; and a nail injecting section 6. The air chamber 2 stores compressed air introduced from an introducing opening 1 that is connected to a compressed air supply source "a" such as an air compressor. The drive piston 3 is driven by the compressed air within the air chamber 2. The drive cylinder 4 slidably accommodates the drive piston 3 therein. The nail injecting section 6 guides the sliding of a driver 5 coupled to the drive piston 3. The compressed air within the air chamber 2 is supplied to the upper surface of the drive piston 3 inside the drive cylinder 4 in accordance with the opening and closing of a main valve 8 that is driven by pulling a trigger 7.

Figure 2:
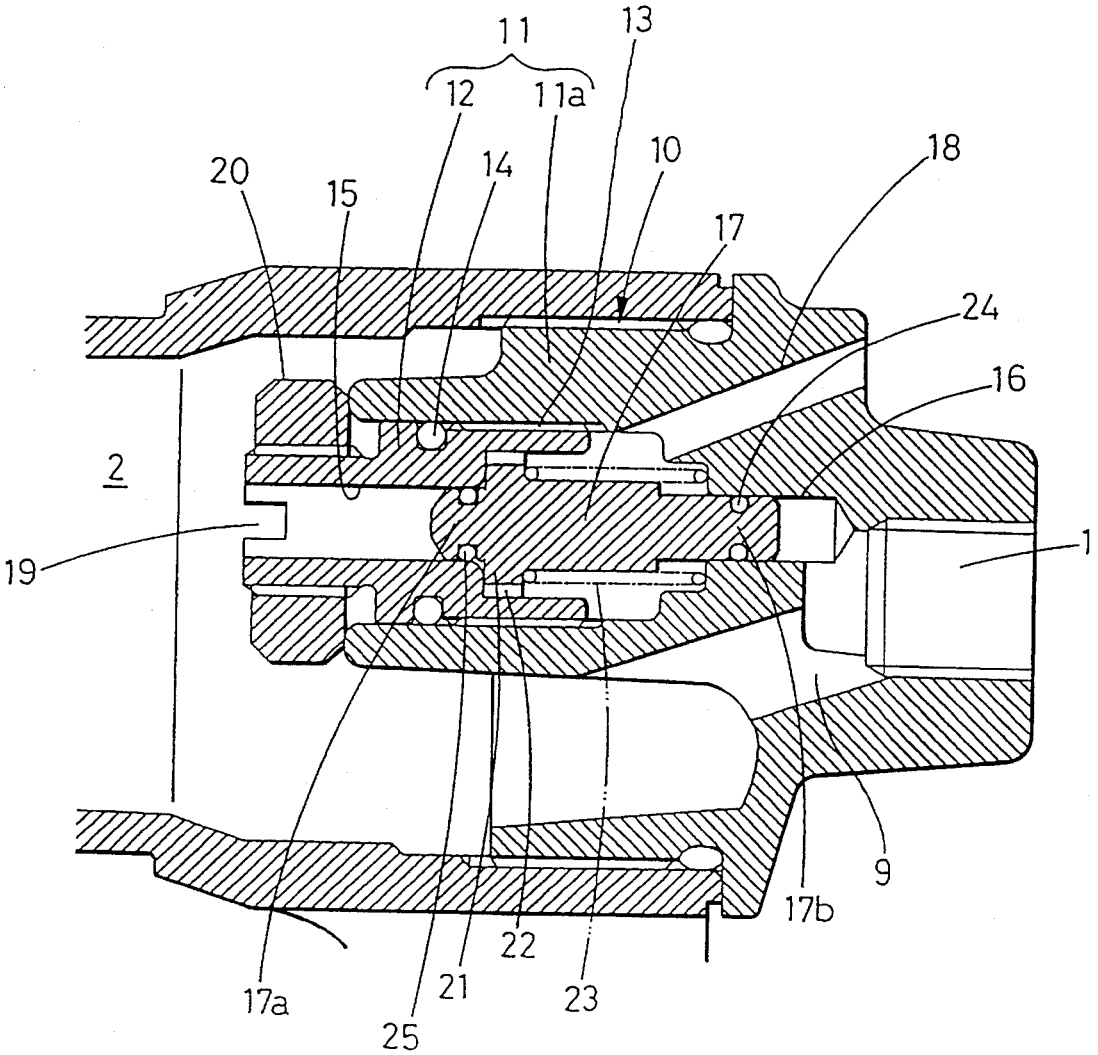
FIG. 2 is a longitudinal sectional view of a relief valve.

The above-mentioned nailing machine is equipped with a safety device that releases the compressed air within the air chamber 2 outside when the air pressure within the air chamber 2 becomes abnormally high. This safety device includes, as shown in FIG. 2, a relief valve 10 that releases the compressed air within the air chamber 2 while juxtaposed with a compressed air passage 9 continued from the introducing opening 1.

The relief valve 10 slidably accommodates a valve stem inside a valve housing 11 and is juxtaposed with the compressed air passage 9.

The valve housing 11 accommodates a cylindrical body 12 on one end side of a housing main body 11*a* (on the side of the air chamber 2) through a screwing section 13 formed of a screw. The inner circumferential surface of the housing main body 11*a* and the outer circumferential surface of the cylindrical body 12 are sealed by an O-ring 14. On one end of the cylindrical body 12 is a first sliding hole 15 that is open onto the air chamber 2. On the other end of the housing main body 11*a* is a second sliding hole 16 that is open onto the introducing opening 1. The diameter of the first sliding hole 15 is slightly larger than that of the second sliding hole 16. The valve stem 17 is slidably accommodated in both sliding holes 15, 16. The portion between the first sliding hole 15 and the second sliding hole 16 has a large diameter and is open onto an air leak hole 18 that communicates with the outside.

To operate the nailing machine, a plug (not shown) will be screwed to connect the compressed air supply source to the introducing opening 1. The sectional area of the air leak hole 18 is set to a value larger than the sectional area of the air flow path of this plug.

On one end of the cylindrical body 12 is an adjusting groove 19. A hexagon nut 20 is screwed to the outer circumference of the adjusting groove 19. The lateral side of the hexagon nut 20 is abutted against the end of the housing main body 11*a*. Since the cylindrical body 12 spirally advances through the screwing section 13 by rotating the cylindrical body 12 with a screwdriver or the like engaged with the adjusting groove 19, the longitudinal position of the cylindrical body 12 with respect to the housing main body 11*a* can be adjusted.

The valve stem 17 is formed so that one end portion 17*a* thereof facing the air chamber 2 has a slightly larger diameter than the other end portion thereof 17*b* facing the introducing opening 1 so as to correspond to the size of the first sliding hole 15 and the second sliding hole 16. Further, in the middle of the valve stem 17 is a flange portion 21 that is engageable with a stepped surface of the cylindrical body 12. The flange portion 21 has notches 22. Still further, between the flange portion 21 and a stepped surface of the housing main body 11*a* is a compression spring 23. The valve stem 17 is urged toward the air chamber 2 by this compression spring 23.

Figure 3:
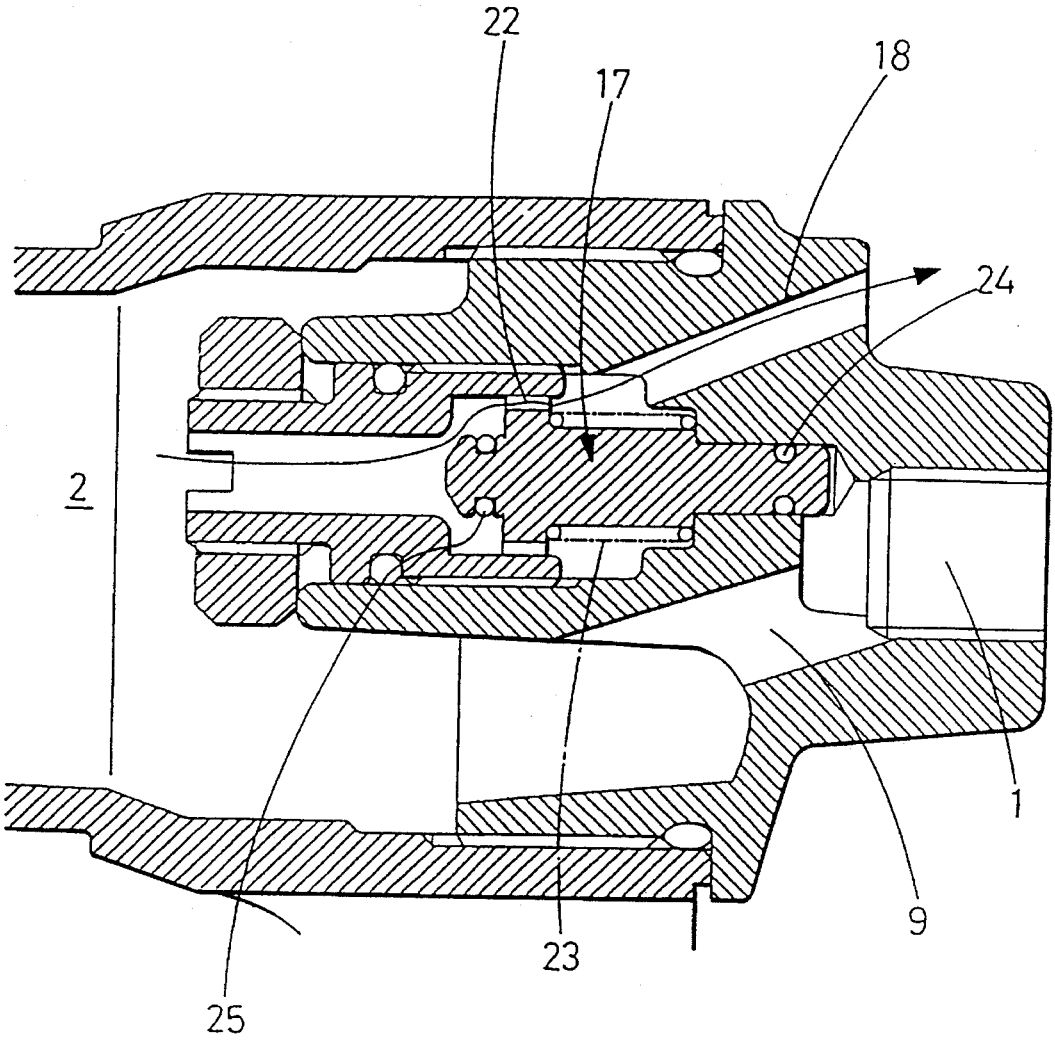
FIG. 3 is a diagram illustrating the operation of the relief valve.

Since the effective pressure receiving area is different between the one end portion 17*a* and the other end portion 17*b* of the valve stem 17, the valve stem 17 is normally urged so as to move toward the introducing opening 1 based on this difference in area. When the spring pressure of the compression spring 23 is larger than the urging pressure, the valve stem 17 slides toward the air chamber 2 as shown in FIG. 2, whereas when the spring pressure becomes smaller than the urging pressure based on the difference in area, the valve stem 17 slides toward the introducing opening 1 as shown in FIG. 3. When the valve stem 17 is positioned on the side of the air chamber 2, the air chamber 2 is shut off from the air leak hole 18. When the valve stem 17 is positioned closer to the introducing opening 1, an O-ring 25 on the one end side of the valve stem 17 is released from the first sliding hole 15, causing the air chamber 2 to communicate with the air leak hole 18 through the notches 22 of the valve stem 17. On the other hand, an O-ring 24 on the side of the other end portion 17*b* of the valve stem 17 keeps the seal without being released from the second sliding hole 16 no matter to which side the valve stem 17 moves.

Since the urging pressure is a differential pressure derived from the difference in the area between both ends of the valve stem 17, such urging pressure differs depending on the magnitude of the air pressure acting on both ends of the valve stem 17. Therefore, the spring load can be adjusted in accordance with the maximum pressure used by the nailing machine. The load of the compression spring can be variably adjusted by adjusting the position of the cylindrical body 12 as described above.

According to the above-mentioned construction, the compressed air sent from the compressed air supply source is introduced from the introducing opening 1, supplied to the air chamber 2 through the compressed air passage 9, and used to drive the drive piston 3 and the like as necessary. When the air pressure within the air chamber 2 is within a predetermined range, pressure of the compression spring 23 is larger than the urging pressure based on the difference in the area between both ends of the valve stem 17, so that the valve stem 17 is urged toward the air chamber 2. Therefore, the air chamber 2 is shut off from the air leak hole 18. However, if the air pressure within the air chamber 2 increases for some reason to make the urging pressure based on the difference in the area between both ends of the valve stem 17 larger than the pressure of the compression spring, then the valve stem 17 moves toward the introducing opening 1 against the pressure of the compression spring. Accordingly, the O-ring 25 on the one end side of the valve stem 17 is released from the first sliding hole 15 to cause the air chamber 2 to communicate with the air leak hole 18, allowing the compressed air within the air chamber 2 to be released outside. As a result, the pressure of the air chamber 2 decreases. In this case, since the area of the air leak hole 18 is set to a value larger than the area of the air flow path of the plug attached to the introducing opening 1, the releasing of the compressed air takes place instantaneously. When the air chamber 2 recovers the predetermined pressure, the spring pressure becomes larger than the urging pressure, thus again causing the air chamber 2 to shut off form the air leak hole 18.

According to the above-mentioned safety device, the movement of the valve stem depends on a difference between the urging pressure and the pressure of the compression spring that urges the valve stem toward the air chamber, the urging pressure being based on the difference in the effective pressure receiving area between the one end portion of the valve stem facing the air chamber and the other end portion thereof facing the introducing opening. Thus, the spring load can be decreased by decreasing such difference in area. Hence, the spring force that urges the valve stem may be weak, which in turn allows the relief valve itself to be downsized even for a nailing machine using high pressure.

Further, when the pressure of the air chamber becomes abnormally high, the valve stem moves against the weak spring force, which can implement fast movement of the valve stem. In addition, the sectional area in which the compressed air flows in from the air chamber by the movement of the valve stem can be increased by increasing the sectional area of the air leak hole. This allows the compressed air within the air chamber to be released instantaneously. Hence, the possibility that the nailing machine will operate during the decreasing of the pressure can be substantially reduced.

What is claimed is:

1. A safety arrangement for a nailing machine, the nailing machine including a machine housing having a compressed air introducing opening and an air leak hole therein, the air leak hole being in contact with outside of the nailing machine, an air chamber for storing compressed air, the compressed air introducing opening allowing air to flow into the air chamber, a drive cylinder juxtaposed with one end of the air chamber, a drive piston enclosed by the drive cylinder, a driver coupled to the drive piston, the safety arrangement comprising:

a relief valve housing having a first end, a second end, and a middle portion, the relief valve housing having a bore therein extending from the first to the second end of the valve housing, the first end of the valve housing communicating with the air introducing opening, the second end of the valve housing communicating with the air chamber, the middle portion of the valve housing communicating with the air leak hole;

a relief valve stem having two ends, the valve stem being slidably disposed within the bore of the valve housing, one end of the relief valve stem facing the air chamber and the other end thereof facing the introducing opening; and a spring for biasing the valve stem in a position that normally blocks communication between the air chamber and the air leak hole, but arranged such that when pressure from the air chamber on the relief valve stem exceeds a predetermined level, the valve stem slides toward the compressed air introducing opening and allows compressed air within the air chamber to be released through the air leak hole to outside of the nailing machine.

2. A safety arrangement according to claim 1, wherein the end of the valve stem facing the air chamber has a larger surface area than the end of the valve stem facing the introducing opening.

3. A safety arrangement for a nailing machine, the nailing machine including a machine housing having a compressed air introducing opening and an air leak hole therein, the air leak hole being in contact with outside of the nailing machine, an air chamber for storing compressed air, the compressed air introducing opening allowing air to flow into the air chamber, a drive cylinder juxtaposed with one end of the air chamber, a drive piston enclosed by the drive cylinder, a driver coupled to the drive piston, such that when compressed air enters the nailing machine through the compressed air introducing opening, the compressed air flows into the air chamber before entering the drive cylinder and causing the drive piston to drive the driver, the safety arrangement comprising:

a relief valve housing having a first end, a second end, and a middle portion, the relief valve housing having a bore therein extending from the first to the second end of the valve housing, the first end of the valve housing communicating with the air introducing opening, the second end of the valve housing communicating with the air chamber, the middle portion of the valve housing communicating with the air leak hole;

a relief valve stem having two ends, the valve stem being slidably disposed within the bore of the valve housing, one end of the relief valve stem facing the air chamber and the other end thereof facing the introducing opening; and a spring for biasing the valve stem in a position that normally blocks communication between the air chamber and the air leak hole, but arranged such that when pressure from the air chamber on the relief valve stem exceeds a predetermined level, the valve stem slides toward the compressed air introducing opening and allows compressed air within the air chamber to be released through the air leak hole to outside of the nailing machine.

* * * * *